United States Patent [19]

Reuter et al.

[11] Patent Number: 4,482,470

[45] Date of Patent: Nov. 13, 1984

[54] VISCOSITY MODIFIERS FOR CONCENTRATED SURFACTANTS

[75] Inventors: Herbert Reuter, Hilden; Lothar Pioch, Düsseldorf; Karl-Heinz Schmid, Mettmann; Wolfgang Seiter, Neuss, all of Fed. Rep. of Germany

[73] Assignee: Henkel Kommanditgesellschaft auf Aktien, Düsseldorf, Fed. Rep. of Germany

[21] Appl. No.: 395,588

[22] Filed: Jul. 6, 1982

[30] Foreign Application Priority Data

Dec. 28, 1981 [DE] Fed. Rep. of Germany ..... 3151679

[51] Int. Cl.[3] ..... C11D 1/02; C11D 1/83

[52] U.S. Cl. ..... 252/162; 252/174.21; 252/174.22; 252/174.23; 252/540; 252/550; 252/553; 252/559

[58] Field of Search ..... 252/559, 540, 174.21, 252/174.22, 174.23, 173, 162, DIG. 14, 557, 550, 553, 558

[56] References Cited

U.S. PATENT DOCUMENTS

| | | | |
|---|---|---|---|
| 3,377,289 | 4/1968 | Stein | 252/109 |
| 3,893,955 | 8/1975 | Hewitt et al. | 252/551 |
| 3,998,762 | 12/1976 | Murata et al. | 252/559 |
| 4,000,080 | 12/1976 | Bartolotia et al. | 252/174.21 |
| 4,198,308 | 4/1980 | Micciche | 252/174.22 |
| 4,261,941 | 4/1981 | Sherman et al. | 252/174.21 |
| 4,316,824 | 2/1982 | Pancheri | 252/174.22 |

FOREIGN PATENT DOCUMENTS

| | | |
|---|---|---|
| 34039 | 8/1981 | European Pat. Off. . |
| 2251405 | 4/1973 | Fed. Rep. of Germany . |
| 35711 | 3/1978 | Japan . |
| 65098 | 6/1981 | Japan . |
| 1402403 | 8/1975 | United Kingdom . |

*Primary Examiner*—Paul Lieberman
*Assistant Examiner*—Hoa Van Le
*Attorney, Agent, or Firm*—Ernest G. Szoke; Henry E. Millson, Jr.; Mark A. Greenfield

[57] ABSTRACT

Process for reducing the viscosity of aqueous concentrates of anionic surfactants by adding thereto a small quantity of a compound containing polyglycol ether groups; and the aqueous concentrates prepared thereby.

11 Claims, No Drawings

VISCOSITY MODIFIERS FOR CONCENTRATED SURFACTANTS

BACKGROUND OF THE INVENTION

When manufacturing powdery or granular detergents and cleaners to be used for large scale production type spray drying processes, the process starts with an aqueous slurry which incorporates most or even all of the detergent constituents. For economic reasons, it is important that the slurry be rich in detergent materials, but poor in liquid ballast materials. Therefore, the least possible amount of water for a slurry make-up is used. However, there are limitations with respect to maximum concentration that can be employed so as not to exceed the highest possible viscosity at which a slurry is still workable, i.e., at which the slurry can still be pumped and sprayed.

The main constituents of detergents and cleaner solutions are surfactants. The anionic surfactants for the manufacture of detergent slurries are usually in form of a paste concentrate with a surfactant content of about 30 to 60 wt. %. A higher surfactant content would be desirable but poses a problem with respect to the workability of concentrated surfactants having high viscosity. A characteristic rheological property of concentrated surfactants is that when adding water to the concentrate the viscosity does not decrease at first but will actually thicken and form a glutinous mass creating problems for the manufacturer. For example, it is not always easy to redissolve the glutinous mass; or unclog the valves on pumps and containers.

In order to try to solve these problems, several approaches have been tried. German Published patent application DE No. 22 51 405 A1 describes the use of salts of certain carboxylic acids, in particular, hydroxycarboxylic acids, as viscosity modifiers. German Published patent application DE No. 23 05 554 A1 discloses that sulfonated aromatic compounds can be used for this purpose. German Published patent application DE No. 23 26 006 A1 describes sulfates or sulfonates of aliphatic, as well as substituted hydrocarbons, as viscosity modifiers. Even the addition of lower alkanols is mentioned in the above publications as agents for modifying viscosity. Furthermore, the addition of known hydrotropes such as cumene sulfonate or acidic phosphoric acid esters (German Published patent application DE No. 16 17 160 A1) or multivalent alcohols of certain carboxylic acids and/or esters of these compounds (European Published application No. 8060 A1) are described. From European Published patent application No. 24 711 A1 it is known that in order to improve the fluidity of anionic surfactant concentrations, sulfates of certain polyalkylene-ether glycols can be added.

However, some additives that are disclosed in the literature will only work for certain surfactants, others dilute the concentrates too much with addtives not otherwise suitable as detergent additives, some are only effective when added in large amounts, and some others such as lower alkanols will lower the flash point to an unacceptable level.

DETAILED DESCRIPTION OF THE INVENTION

The present invention relates to a process for reducing the viscosity of aqueous concentrates of anionic surfactants so that higher surfactant concentrations than where possible heretofore can be utilized successfully, and which furthermore will not thicken upon the addition of water thereto.

It has now been found that the addition of a relatively small quantity of a compound containing polyglycol ether groups to an aqueous concentrate of an anionic surfactant results in significant lowering of the viscosity of the concentrate.

More particularly, the addition of up to about 10 wt. %, e.g. from about 0.1 to about 10 wt. %, preferably from about 0.1 to about 5 wt. %, and more preferably from about 0.5 to about 3 wt. %, based on the weight of the aqueous concentrate, of a compound containing polyglycol ether groups as a viscosity modifier will produce the desired lowering of viscosity of the surfactant concentrate. The amount of viscosity modifier selected for any particular concentrate is dependent on the decrease in viscosity desired, and this can be readily determined by routine experimentation. In some cases, the maximum decrease in viscosity that can be obtained is reached after the addition of only 3 wt. % of a viscosity modifier of the invention.

The compounds containing polyglycol ether groups that can be used as viscosity modifiers in accordance with the invention include:

(a) polyethylene glycols having a molecular weight of from about 600 to about 6000;

(b) polypropylene glycols having a molecular weight of from about 250 to about 4000;

(c) adducts of from about 20 to about 80 moles of ethylene oxide with an aliphatic alcohol having from 10 to 20 carbon atoms; and (d) adducts of from about 20 to about 60 moles of ethylene oxide with an alkyl phenol having from 6 to 12 carbon atoms in the alkyl group.

The polyethylene and polypropylene glycols ((a) and (b) above, respectively) that are suitable as viscosity modifiers for use in the invention are derivatives of glycols having 2 to 3 carbon atoms. Especially useful are polyethylene glycols with a molecular weight of from about 1000 to about 4000, preferably from about 1500 to about 2500. Such products are commercially available under the name of "Polywachs" (Chem. Comp. Hüls, Marl, Germany). Especially suitable polypropylene glycols are those having a molecular weight of from about 400 to about 2000, preferably from about 400 to about 800.

Adducts of ethylene oxide with an aliphatic alcohol ((c) above) that can be used as a viscosity modifier in the practice of the invention include alcohols of fatty acids, and derived from natural fats, such as coconut oil or tallow fat. Ziegler or oxoalcohol ethoxylates with an ethoxylate range of 30 to 80 moles of ethylene oxide per mole of alcohol can also be used, for example, about 40 to about 60 moles of ethylene oxide per mole of alcohol gives a product that produces very good results. A very effective viscosity modifier for $\alpha$-sulfo fatty acid ester and alkyl aryl sulfonate surfactant concentrates is, e.g., the adduct of 50 moles of ethylene oxide with 1 mole of tallow alcohol.

Suitable alkyl phenol ethoxylates ((d) above) have 6 to 12, but usually 9 carbon atoms in the alkyl group, and preferably from about 30 to about 50 moles of ethylene oxide per mole of alkyl phenol in the molecule. The adduct consisting of 40 moles of ethylene oxide with 1 mole of nonyl phenol is an example of a very effective viscosity modifier for concentrates of $\alpha$-sulfo fatty acid esters and alkyl aryl sulfonates.

The concentrated surfactants that can have their viscosity modified by the viscosity modifiers of the invention normally contain one or more of the following types of surfactants:

I. α-Sulfo fatty acid esters (SFE)

These surfactants are derivatives of fatty acids with 10 to 20, preferably 12 to 18 carbon atoms, and aliphatic alcohols with 1 to 10, preferably 1 to 2 carbon atoms in the molecule. The introduction of the sulfo group is achieved either by sulfonation of the fatty acid with subsequent esterification of the carboxyl group with alcohol, or sulfonation of the appropriate fatty acid ester. Both processes will yield esters of sulfo fatty acids which have the sulfo acid group in the α-position. Especially suitable α-sulfo fatty acid esters to be used as surfactants are the alkali metal or ammonium salts of the methyl and ethyl esters of tallow fatty acids with a sulfo group in the α-position, and with the acid component consisting mainly of saturated $C_{16}$ and $C_{18}$ fatty acids.

II. Alkyl Sulfates (FAS)

Surfactants of this group consist of sulfuric acid esters of fatty alcohols. The alcohol component can be saturated or unsaturated, and has, as a rule 8 to 24, preferably 10 to 18 carbon atoms. The alcohol can be a derivative of coconut oil or tallow fat. These alkyl sulfates are usually in the form of their alkali metal or ammonium salts.

III. Alkylaryl sulfonates (ABS)

ABS are usually sulfonation products of an alkyl benzene. The alkyl group can be straight or branched chain, saturated or unsaturated. Preferred is an alkyl radical with 4 to 16, preferably 6 to 14 carbon atoms. Especially important are ABS having alkyl radicals with 8 to 12 carbon atoms. ABS are usually available as their alkali metal or ammonium salts.

The surfactant concentrates currently being processed commercially, which have the disadvantages discussed above for the prior art processes, usually contain about 30 wt. % surfactant, where the surfactant is an α-sulfo fatty acid ester or an alkyl sulfate, and about 50 to 60 wt. % surfactant where the surfactant is an alkylaryl sulfonate. Use of a viscosity modifier of the invention in the above concentrates at their normal processing temperatures, i.e., a temperature in the range of about 50° to about 90° C., will usually lower the viscosity to at or less than 10,000 cps., which is the maximum viscosity for satisfactory commercial use, e.g. for mixing with other detergent constituents or spraying. In addition to the above advantage, it has also been found that the quantity of surfactant in the concentrates can be increased another 3 to 15 wt. % without exceeding a viscosity of 10,000 cps. Hence, the concentrates produced by the use of a viscosity modifier of the invention contain less water than prior commercially used concentrates, resulting in important manufacturing economics in addition to resulting in improved quality of the detergent compositions.

In addition to the presence of a viscosity modifier of the invention in the anionic surfactant concentrates of the invention, other surface active agents or other additives may also be added, such as inorganic salts, e.g. sodium sulfate, trisodium phosphate, alkali metal hydroxides, etc. These inorganic salts are particularly effective as additional viscosity modifiers with alkyl sulfate surfactant concentrates.

The invention will be better understood from the following examples, which are given for illustration purposes only.

EXAMPLES

I. α-Sulfo fatty acid ester concentrates

EXAMPLE 1

An aqueous concentrate of α-sulfo tallow fatty acid, methyl ester of about 29 wt. % active ingredients, when used in a temperature range of 40° to 65° C. and without adding any viscosity modifiers, exhibited a viscosity between 31,000 cps. (40° C.) and 25,000 cps. (65° C.). After adding 1.5 wt. % (in relation to the concentrate) of an adduct of nonyl phenol+20 moles of ethylene oxide, the concentrate had a viscosity of about 1,500 cps. (65° C.) and about 14,000 cps. (40° C.). Similar or better results were obtained when the same amount of nonyl phenol with 40 or 60 moles of ethylene oxide were used as the viscosity modifiers. A much reduced effectiveness resulted with the same quantity of nonylphenol+10, and nonylphenol+6.5 moles of ethylene oxide, which are typical surfactants used with detergents.

EXAMPLE 2

Another batch of the α-sulfo tallow fatty acid methyl ester concentrate of EXAMPLE 1 was mixed with 1.5 wt. % of an adduct of tallow alcohol+25 moles ethylene oxide. The viscosity was about 1,500 cps. (65° C.) and about 22,000 cps. (40° C.). Additions in the same amount of an adduct of tallow alcohol+50 moles of ethylene oxide or an adduct of tallow alcohol+80 moles of ethylene oxide to fresh batches of the concentrate showed similar or better results, whereas typical surfactants for laundry detergents such as an adduct of tallow alcohol+14 moles of ethylene oxide and an adduct of tallow alcohol+5 moles of ethylene oxide gave worse results.

EXAMPLE 3

The same concentrate as was used in the above examples was mixed with 1.5 wt. % polypropylene glycol, molecular weight 2000. The viscosity decreased to 3000 cps. (65° C.) and 10,000 cps. (40° C.). When the same quantities of polypropylene glycol with molecular weights of 400 and 600, respectively, were added the viscosity was less than 6000 cps. at 40° C.

EXAMPLE 4

The same surfactant concentrate as was used in the above examples was mixed with 1.5 wt. % polyethylene glycol, molecular weight 2000. The viscosity decreased to about 9000 cps. (40° C.) and to about 1000 cps. (65° C.). When using the same quantity of other polyethylene glycols with molecular weights between about 1000 and about 4000, similar results were obtained; however, the viscosity modifying properties were remarkably diminished when using the same quantity of polyethylene glycols with molecular weights below 1000.

II. Alkylaryl sulfonate concentrates

EXAMPLE 5

An alkyl benzene sulfonate paste with 59 wt. % active ingredients, had a viscosity of about 17,000 cps. (40° C.) and about 13,000 cps. (55° C.) without the addition of a viscosity modifier. After adding 1.5 wt. % of polyethylene glycol, molecular weight 2000, the viscosity was then only about 2,800 cps. (40°–55° C.). Similar results were obtained when adding to a portion of the above paste the same amount of an adduct of tallow alcohol+50 moles of ethylene oxide or an adduct of nonylphenol+40 moles of ethylene oxide; the same quantity of an adduct of tallow alcohol+14 moles of ethylene oxide did not exhibit as much reduction of viscosity.

III. Alkyl sulfate concentrates

EXAMPLE 6

A tallow alcohol sulfate paste with 31.2 wt. % active ingredients had a viscosity of about 35,000 cps. (55° C.) and about 13,000 cps. (80° C.) without any viscosity modifier. After adding 1.5 wt. % of polyethylene glycol, molecular weight 2000, the viscosity decreased to about 10,000 cps. (55° C.) and about 8000 cps. (80° C.).

EXAMPLE 7

A tallow alcohol sulfate paste with 30.1 wt. % active ingredients, and without any addition of viscosity modifier, had a viscosity of about 35,000 cps. (55° C.) and about 10,000 cps. (80° C.). When 2.0 wt. % of polyethylene glycol, molecular weight 2000 was added thereto, a reduction of viscosity to values of about 22,000 cps. (55° C.) and about 6000 cps. (80° C.) was obtained. The addition of 3 wt. % of an adduct of nonylphenol+20 moles of ethylene oxide to another sample of the paste resulted in a viscosity of 9,500 cps. (55° C.) and 3,000 cps. (80° C.). When 3 wt. % of an adduct of tallow alcohol+25 moles of ethylene oxide was added to a sample of the paste, a reduction of viscosity to 21,000 cps. (55° C.) and 2100 cps. (80° C.) was obtained.

What is claimed is:

1. A process for the manufacture of powdery or granular spray dried detergents and cleaners comprising the steps of:

I. forming an aqueous anionic surfactant concentrate having a viscosity of 10,000 CPS or less at a temperature in the range of 50° to 90° C. comprising A. an anionic surfactant component which is either (a) at least about 33 wt. %, based on the weight of the concentrate, of an alkali metal salt of an α-sulfo fatty acid ester or an alkali metal salt of an alkyl sulfate, or (b) at least about 53 wt. %, based on the weight of the concentrate, of an alkali metal salt of an alkyl aryl sulfonate; and B. from about 0.1 to about 10% by weight of the concentrate of at least one viscosity modifier selected from the group consisting of:

(a) a polyethylene glycol having a molecular weight of from about 600 to about 6000;

(b) a polypropylene glycol having a molecular weight of from about 250 to about 4000;

(c) an adduct of from about 20 to about 80 moles of ethylene oxide with an aliphatic alcohol having from 10 to 20 carbon atoms; and (d) an adduct of from about 20 to about 60 moles of ethylene oxide with an alkyl phenol having from 6 to 12 carbon atoms in the alkyl group; and wherein the aqueous anionic surfactant concentrate in the absence of component B. has a viscosity of more than 10,000 CPS at a temperature in the range of 50°–90° C.; and II. processing the concentrate formed in I. above at a temperature in the range of from about 50° C. to about 90° C.

2. A process in accordance with claim 1 wherein the viscosity modifier in Step I.B. is present in from about 0.1 to about 5 wt. %.

3. A process in accordance with claim 1 wherein the viscosity modifier in Step I.B. is present in from about 0.5 to about 3 wt. %.

4. A process in accordance with claim 1, 2 or 3 wherein the viscosity modifier in Step I.B. is a polyethylene glycol having a molecular weight of from about 1000 to about 4000.

5. A process in accordance with claim 4 wherein the molecular weight of the polyethylene glycol is from about 1500 to about 2500.

6. A process in accordance with claim 1, 2, or 3 wherein the viscosity modifier in Step I.B. is a polypropylene glycol having a molecular weight of from about 400 to about 2000.

7. An aqueous concentrate in accordance with claim 6 wherein the molecular weight of the polypropylene glycol is from about 400 to about 800.

8. A process in accordance with claim 1 2 or 3 wherein the viscosity modifier in Step I.B. is an adduct of ethylene oxide with an aliphatic alcohol wherein from 40 to 60 moles of ethylene oxide are present.

9. A process in accordance with claim 8 wherein the viscosity modifier is an adduct of 50 moles of ethylene oxide with tallow fatty alcohol.

10. A process in accordance with claim 1, 2 or 3 wherein the viscosity modifier in Step I.B. is an adduct of from about 30 to about 50 moles of ethylene oxide with a nonyl phenol.

11. A process in accordance with claim 1, 2, 3, 4, 5, 6, 7, 8, 9 or 10 wherein the aqueous anionic surfactant concentrate in Step I. contains one or more other surface active agents and/or additives.

* * * * *